US005543768A

United States Patent [19]

Murakami et al.

[11] Patent Number: 5,543,768

[45] Date of Patent: Aug. 6, 1996

[54] COMPOSITE OF HIGH-TEMPERATURE SUPERCONDUCTIVE BULK FORM WITH COIL MAGNET

[75] Inventors: Masato Murakami; Hiroshi Takaichi; Shoji Tanaka; Naomichi Sakai, all of Tokyo, Japan

[73] Assignee: International Superconductivity Technology Center, Tokyo, Japan

[21] Appl. No.: 319,569

[22] Filed: Oct. 7, 1994

[30] Foreign Application Priority Data

Oct. 13, 1993 [JP] Japan ..... 5-280126

[51] Int. Cl.[6] ..... H01F 1/00

[52] U.S. Cl. ..... 335/216

[58] Field of Search ..... 335/216; 310/90.5; 505/212–213, 869, 879, 166

[56] References Cited

U.S. PATENT DOCUMENTS

| | | | |
|---|---|---|---|
| 5,289,150 | 2/1994 | Rabinowitz | 335/216 |
| 5,334,964 | 8/1994 | Voigt et al. | 505/211 |

FOREIGN PATENT DOCUMENTS

| | | | |
|---|---|---|---|
| 404147 | 12/1990 | European Pat. Off. | 335/216 |
| 0486698 | 5/1992 | European Pat. Off. . | |
| 0583749 | 2/1994 | European Pat. Off. . | |
| 2688356 | 9/1993 | France . | |
| WO90/02407 | 3/1990 | WIPO . | |

OTHER PUBLICATIONS

Patent Abstracts of Japan, vol. 17, No. 322 (N–1432), Jun. 18, 1993, JP–A–05 033827, Feb. 9, 1993.

Patent Abstracts of Japan, vol. 16, No. 172 (C–0933), Apr. 24, 1992, JP–A–04 016510, Jan. 21, 1992.

Cryogenics, vol. 30, Sep. 1990, L. Z. Lin, et al., "High Field Superconducting Magnet Design with High Tc Oxide Superconductors", pp. 951–955.

Japanese Journal of Applied Physics, vol. 27, No. 6, Jun. 1988, pp. L1120–L1122, Takeo Hattori, et al., "Magnetic Shielding Using High–Tc Superconductor".

IEEE Translation Journal of Magnetics in Japan, vol. 6, No. 7, Jul. 1991, T. Uchiyama, et al., "Nonlinear Inductance of High Tc Superconducting Magnetic Core and Its Application to Quick Response Magnetic Sensors", pp. 604–613.

*Primary Examiner*—Leo P. Picard

*Assistant Examiner*—Raymond M. Barrera

*Attorney, Agent, or Firm*—Oblon, Spivak, McClelland, Maier & Neustadt, P.C.

[57] ABSTRACT

A composite magnet comprising a core of R-Ba-Cu-O type bulk superconductor (R denotes rare-earth elements) made by melt process, enclosed around it with normal conductive or superconductive coil, or a composite magnet including a center of normal conductive or superconductive coil, enclosed around it with ring-shaped R-Ba-Cu-O type bulk superconductor (R denotes rare-earth elements) made by melt process is disclosed, which allows easy control of generating magnetic field and gives a relatively strong magnetic field even at a temperature as high as that of liquid nitrogen.

5 Claims, 3 Drawing Sheets

COMPOSITE OF HIGH-TEMPERATURE SUPERCONDUCTIVE BULK FORM WITH COIL MAGNET

BACKGROUND OF THE INVENTION

The present invention relates to a bulk high-temperature superconductive magnet with freely variable strength of magnetic field obtainable by combining a high-temperature superconductive bulk form with high critical current with an normal conductive or superconductive coil, which allows the stabilization of conventional superconductive coil and the more extended application of superconductive magnet. The magnet with this structure is utilizable for, for example, the stabilization of superconductive coil for magnetic levitated train, etc.

With the discovery of oxide superconductor represented by R-Ba-Cu-O type (R denotes rare-earth elements, hereinafter it means the same) with critical temperature ($T_c$) exceeding 90K, it has become possible to use liquid nitrogen as a coolant for superconductor. For putting the superconductor into practice, it is required to process this into wire, tape or the like. It is the status quo however that, in this form, the critical current being most important in the practice of superconductor is low and has not reached the practical level at 77K.

For example, Bi-Sr-Ca-Cu-O type superconductor is relatively easy to process into tape. Thus, a tape with length exceeding 100 m has already been made and a pancake coil that generates a magnetic field exceeding 1 T is manufactured, but it exhibits only around 0.1 T at a temperature of liquid nitrogen at most.

In the case of Bi-Sr-Ca-Cu-O type material, the anisotropy is significant in the crystal structure and, while the critical current is relatively high when applying the magnetic field perpendicularly to the c-axis of crystal, it becomes very low when applying parallel, which is considered to be a problematic point at the time of using liquid nitrogen.

On the other hand, with R-Ba-Cu-O type superconductor made by melt process, the optimization of flux pinning effect has been achieved though in the state of bulk, and very high critical current at practical level is achieved even at a temperature of liquid nitrogen. Such bulk form exhibits a high repulsive force and attractive force through the interaction with magnetic field, hence application to bearing etc. is investigated. Moreover, trapping of magnetic field is also possible, leading to a magnetic field exceeding 1 T at a temperature of liquid nitrogen.

With conventional superconductor, if attempting to use it in bulk form, so-called quenching phenomenon, in which the superconductivity is broken abruptly by a small external disturbance, occurred because of low specific heat, making it impossible to utilize in the stable state. In the case of linear motor car, the practicality being investigated currently, this quenching is posing a problem. Whereas, the high-temperature superconductor has an advantage of being usable stably even in bulk.

As described above, there is a problem that, with bulk superconductor alone, high magnetic field can be generated, but the control of that generated magnetic field is difficult. Moreover, there is a problem that, with superconductive coil alone using a tape of high-temperature superconductor, the generating magnetic field can be controlled by the level of current, but the generating magnetic field is too weak at a temperature as high as that of liquid nitrogen.

In addition, while the superconductive coal capable of generating large magnetic field is manufactured using low-temperature superconductive material and the application to linear motor car is investigated utilizing the mutual repulsion between magnets, it cannot necessarily be said that the practicality is high.

As a result of extensive investigations for overcoming the respective drawbacks of high-temperature superconductive bulk magnet, high-temperature superconductive coil and low-temperature superconductive coil, the inventors have known that a composite constituted by appropriately combining high-temperature superconductive bulk form with normal conductive or superconductive coil is possible to be utilized in the stable state, leading to the completion of the invention.

SUMMARY OF THE INVENTION

The first invention of the present invention relates to a composite magnet with a structure comprising a core of R-Ba-Cu-O type bulk superconductor made by melt process, enclosed around it with normal conductive or superconductive coil, moreover, the second invention, with a structure comprising a center of normal conductive or superconductive coil, enclosed around it with ring-shaped R-Ba-Cu-O type bulk superconductor made by melt process, and furthermore, the third invention, with a structure comprising a core of R-Ba-Cu-O type bulk superconductor made by melt process, enclosed around it with normal conductive or super conductive coil, and further disposed outside thereof with ring-shaped R-Ba-Cu-O type bulk superconductor made by melt process.

DETAILED DESCRIPTION OF THE INVENTION

Figure 1:
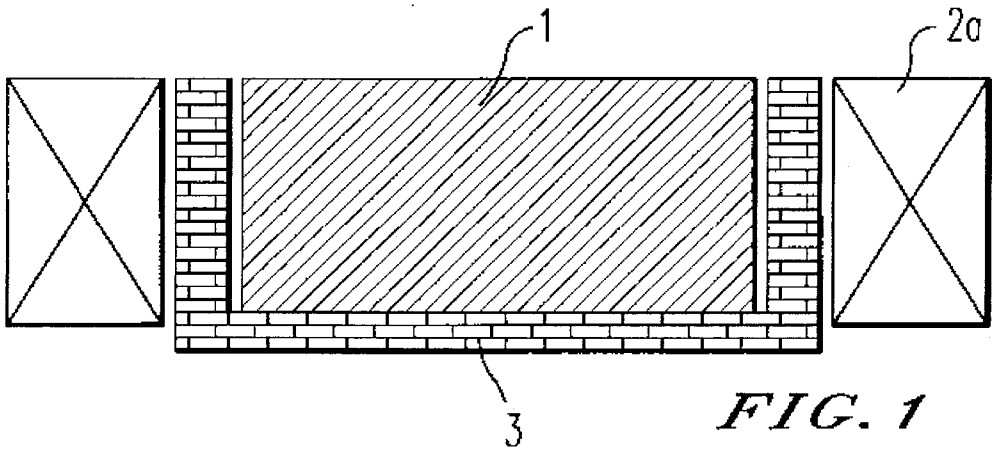
FIG. 1 is a diagram showing one practical embodiment of the first invention of the present invention and a sectional view showing the constitution of composite magnet of Example 1.
Figure 2:
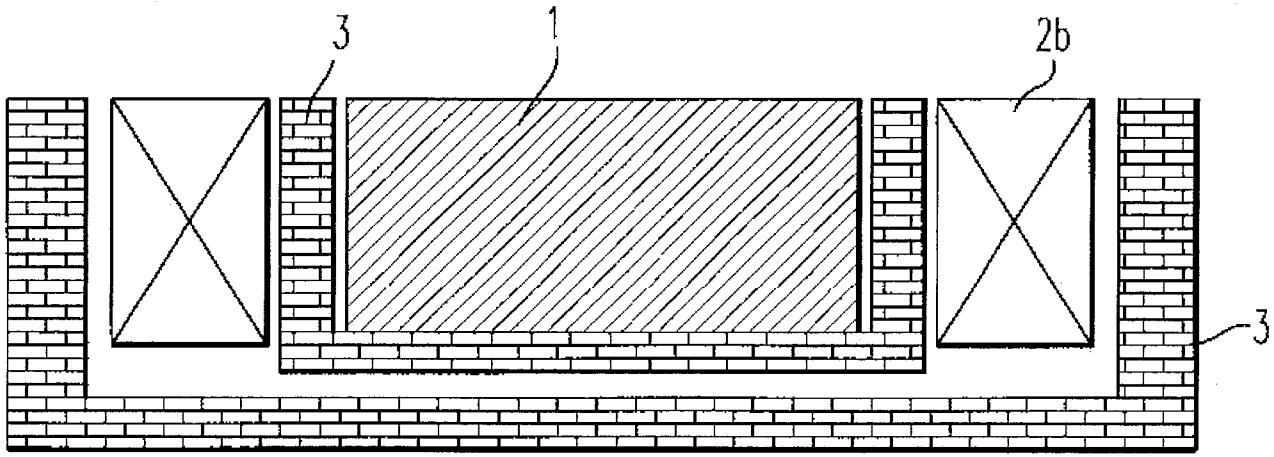
FIG. 2 is a diagram showing one practical embodiment of the first invention of the present invention and a sectional view showing the constitution of composite magnet of Example 2.
Figure 3:
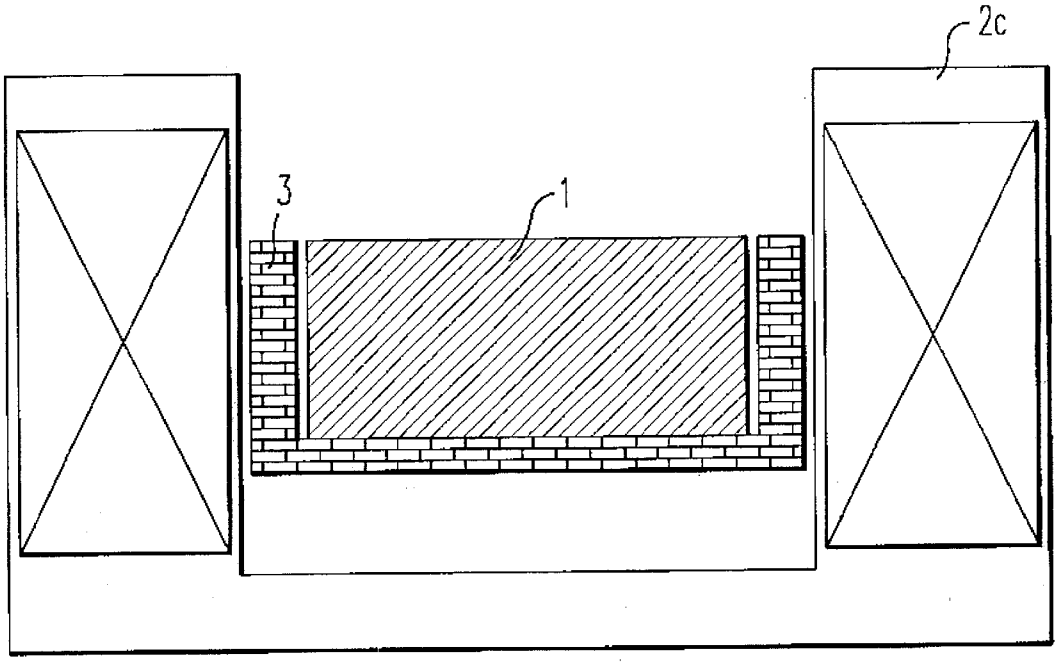
FIG. 3 is a diagram showing one practical embodiment of the first invention of the present invention and a sectional view showing the constitution of composite magnet of Example 3.

In following, the invention wall be illustrated in more detail referring to the drawings. FIGS. 1 through 3 are diagrams each showing one practical embodiment of the first invention of the present invention, and FIGS. 4 and 5, of the second and the third inventions, respectively. In the diagrams, numeral 1 indicates a superconductive bulk form, numeral 2*a*, 2*b* or 2*c*, a normal conductive or superconductive coil, and numeral 3, a container.

The superconductive bulk form (1 in the diagrams) constituting the invention is a R-Ba-Cu-O type superconductor. R denotes rare-earth elements and comprises one or more elements selected from a group consisting of Y, Bm, Eu, Gd, Dy, Mo and Er. The proportion of the constituting components of this superconductor is not particularly restricted and is only necessary to be a constituting proportion exhibiting the superconductivity. Moreover, this superconductor is one made by melt process, which gives high critical current even in a high magnetic field.

The normal conductive or superconductive coil shown by numeral 2*a*, 2*b* or 2*c* in the diagrams comprises, for example, normal conductive substances such as copper. Bi type and Nb-Ti type superconductive substances, and the like.

In the invention, said superconductive bulk form and normal conductive or superconductive coil are arranged in the shape of holding the central axes thereof in common.

The second invention of the present invention is one arranged the superconductive bulk form around the normal conductive or superconductive coil. For more improving the synergistic effect due to such combination of coil with bulk form, it is preferable to make the superconductive bulk form thicker than said coil in the thicknesses thereof in the direction of central axis.

These constitutional matters of the invention are accommodated in a container (3 in the diagrams) and the container is usually made of stainless steel.

When making the composite with the structure enclosed high-temperature superconductive bulk form with superconductive coil, it becomes possible to actively control the magnetic field generated by bulk magnet through the adjustment of coil current. Also, when enclosing the coil made of high-temperature superconductor (e.g. Bi-Sr-Ca-Cu-O) with high-temperature superconductive (e.g. Y-Ba-Cu-O) bulk form, the bend at the outer edge portion of magnetic field is suppressed.

As described above, with Bi type material, the anisotropy of critical current is significant depending on the direction of magnetic field. Hence, with the pancake type coil manufactured with a tape using this material, the preferential direction may be available, but the influence in the direction of low critical current appears eventually because of the bend of magnetic field.

However, if covering the surroundings of said coil with bulk form as above, then the bend of magnetic field is suppressed and the critical current only in the preferential direction becomes available resulting in the improvement in generated magnetic field.

In addition, when arranging the high-temperature superconductive bulk at the center of low-temperature superconductive coil, even if the low-temperature superconductor may be quenched, for example, in the case of utilizing this for magnetic levitation etc., the bulk form keeps the state, thus allowing the alleviation of abrupt change.

In following, the invention will be illustrated based on the examples.

EXAMPLE 1

$Y_2O_3$, $BaCO_3$ and CuO were mixed so as the ratio of Y:Ba:Cu to become 1.8:2.4:3.4 and calcined for 24 hours at 900° C. After heating further for 20 minutes at 1400° C., the mixture was quenched by using copper hammers and then pulverized finely using a mortar and pestle. The pulverized powder was press-molded in a size of diameter of about 5 cm and height of 2 cm. After heating for 20 minutes at 1100° C., this was cooled to 1000° C. over 1 hour and, after cooling to 900° C. at a rate of 1° C. per hour, it was cooled to room temperature in furnace. Thereafter, it was heated for 100 hours at 500° C. in oxygen of 1 atm.

Next, around this Y-Ba-Cu-O superconductive material, a copper wire capable of passing a current of at highest 10 A was wound 1000 turns. The constitution is shown in FIG. 1. In the diagram, numeral (1) indicates the Y-Ba-Cu-O superconductor, numeral (2*a*), the copper coil and numeral (3), a container. With this coil, a magnetic field of about 1 KG generates at the central portion in the state of passing a current of 5 A.

The superconductor was cooled in the state of passing the current of 5 A through coil using liquid nitrogen and the current of coil was turned off. As a result of measuring the magnetic field at the central portion of superconductor using a Hall sensor, it had 1 KG. Following this, when passing a current of opposite direction through coil, the magnetic field of superconductor became smaller gradually, resulting in approximately zero at the outer circumference at 5 A.

As described, when using superconductor and copper coil, it becomes possible to control the magnetic field of bulk superconductive magnet.

EXAMPLE 2

Y-Ba-Cu-O superconductor was manufactured by the same method as manufactured in Example 1 and, around it, a Pb-Bi-Sr-Ca-Cu-O silver tape (critical temperature 105 K) made by powder-in-tube process was wound 100 turns in the shape of pancake type coil. This tape has a critical current of about 12 A at a temperature of liquid nitrogen and a magnetic field of 500 G generates only with coil.

A composite of this Y-Ba-Cu-O bulk superconductor with the Pb-Bi-Sr-Ca-Cu-O superconductive tape was dipped into liquid nitrogen and current was passed through tape, but the inner magnetic field had approximately zero. This is because of that the magnetic field is shielded by the Y-Ba-Cu-O superconductor.

Here, next, as shown in FIG. 2, the Y-Ba-Cu-O superconductor (1) was placed in a stainless steel container (3) and separated from the Pb-Bi-Sr-Ca-Cu-O superconductive tape coil (2*b*). In this state, a current of 10 A was passed through tape and then the Y-Ba-Cu-O superconductor was cooled with liquid nitrogen. Thereafter, the current of tape was turned off. As a result of measuring the magnetic field at the central portion of superconductor with a Hall sensor, it had 500 G. Following this, when passing a current of opposite direction through tape, the magnetic field in superconductor decreased gradually resulting in the magnetic field at outer circumference being approximately zero at 10 A. In this way, by covering the surroundings of bulk superconductor with normal conductive or superconductive coil, it becomes possible to make the magnetic field of superconductor variable.

EXAMPLE 3

A commercial NbTi superconductive coil (bore diameter 6 cm, maximum magnetic field at center 5 T) was prepared. Bore forms a space at room temperature. A stainless steel container was inserted into this bore. Next, a bulk Y-Ba-Cu-O superconductor (1) made by the method in Example 1 was placed in a stainless steel container (3). The constitution is shown in FIG. 3. In the state of being 2 T excited by the NbTi superconductive coil (2*c*), the superconductor was cooled with liquid nitrogen. Following this, even if demagnetizing the outer superconductive coil, the bulk superconductor remained to trap the magnetic field of 2 T.

In this state, an overcurrent was passed through coil to quench. Thereafter, as a result of measuring the magnetic field of bulk superconductor, it remained to be 2 T. In this way, with the superconductive coil with a core of bulk superconductor, even if the low-temperature superconductive coil may be quenched, the high-temperature superconductor can maintain the magnetic field to some extent, making it possible to hinder an abrupt change in magnetic field.

EXAMPLE 4

By the same method as in Example 1, two 10 cm diameter and 4 cm high Y-Ba-Cu-O superconductors were manufactured. At the central portion thereof, a 8 cm diameter bore was provided. Next, a Pb-Bi-Sr-Ca-Cu-O superconductive tape wound in the shape of about 7.5 cm diameter pancake type coil was prepared. The generated magnetic field of this coil at a temperature of liquid nitrogen was 1 KG.

Figure 4:
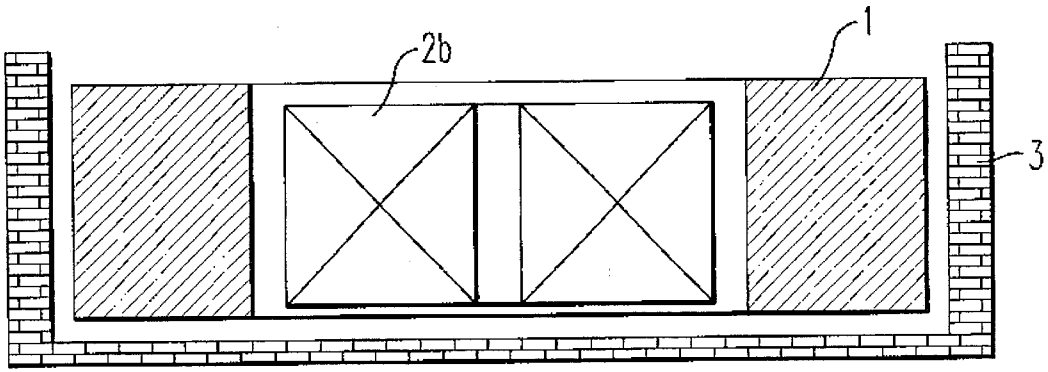
FIG. 4 is a diagram showing one practical embodiment of the second invention of the present invention and a sectional view showing the constitution of composite magnet of Example 4.

As shown in FIG. 4, this pancake coil (2*b*) was placed in a ring of Y-Ba-Cu-O superconductor (1) and current was supplied. When measuring the generated magnetic field, the magnetic field increased to 2 KG. This is because of that the bend of magnetic field at the outer edge of coil was suppressed by the Y-Ba-Cu-O superconductive ring. Besides, the thickness of coal (2*b*) in the axial direction was made thinner than that of superconductor (1) as shown in FIG. 4.

Namely, the Bi type superconductor has a significant anisotropy. Hence, when applying the magnetic field perpendicularly to the face of tape, the direction becomes advantageous for critical current, but the magnetic field exiting coil bends immediately, thus generating a magnetic field with parallel component to the face of tape at the outer edge. For this reason, the generated magnetic field becomes small. However, when enclosing around the coil with the Y-Ba-Cu-O superconductor ring, the bend of this magnetic field is suppressed and, in consequence, the critical current improves and the generating magnetic field also increases.

EXAMPLE 5

Figure 5:
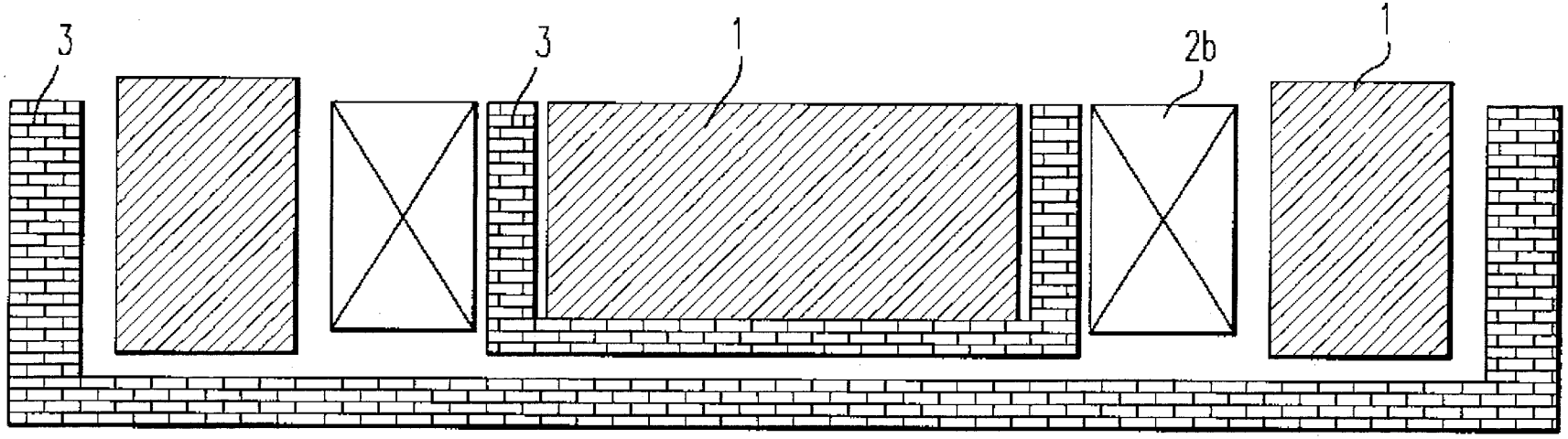
FIG. 5 is a diagram showing one practical embodiment of the third invention of the present invention and a sectional view showing the constitution of composite magnet of Example 5.

By the same method as in Example 1, two 4 cm diameter and 2 cm high and 10 cm diameter and 3 cm high Y-Ba-Cu-O superconductors were manufactured. Next, a 8 cm diameter bore was provided through the 10 cm diameter Y-Ba-Cu-O superconductor to process to ring shape. And, as shown in FIG. 5, the 4 cm diameter Y-Ba-Cu-O superconductor (1) was placed in a stainless steel container (3), Pb-Bi-Sr-Ca-Cu-O superconductive tape coil (2*b*) with same quality as used in Example 2 was wound therearound, and further the surroundings thereof was enclosed with the 10 cm outer diameter Y-Ba-Cu-O superconductor ring (1).

Cooling was made with liquid nitrogen except the innermost portion and, when passing a current through tape in this state, a magnetic field of about 2 KG generated at the central portion. Next, the innermost Y-Ba-Cu-O superconductor was cooled with liquid nitrogen and the power source of tape was turned off. In this state, a magnetic field of 2 KG generated in the innermost superconductor. In such structure, the magnetic field of Pb-Bi-Sr-Ca-Cu-O superconductive tape coil generates effectively by the outermost Y-Sa-Cu-O superconductor and the innermost Y-Be-Cu-O superconductor acts as a magnet.

EXAMPLE 6

By the same method as in Example 1, R-Ba-Cu-O (R:Sm, Eu, Gd, Dy, Ho or Er) superconductors (diameter 4 cm, height 2 cm) were manufactured. However, in the last heat treatment, the starting temperatures for gradual cooling were made as follows: Sm:1060° C. Eu:1050° C., Gd:1030° C., Dy:1010° C., Ho:990° C. and Er:980° C. Using these as the cores, copper coil was wound around each of them. When examining the characteristic thereof, it was confirmed that all recorded a central magnetic field of about 1 KG and, when inverted the current, the magnetic fields at the outer circumference became zero.

As described above, in accordance with the invention, the control of generating magnetic field is easy and relatively strong magnetic field can be obtained even at a temperature as high as that of liquid nitrogen.

What is claimed is:

1. A variable magnetic field strength composite magnet, comprising:

a core of R-Ba-Cu-O bulk superconductor, where R is at least one rare-earth element, said superconductor being made by a melt process; and an electrically conductive coil driven by an external power source enclosing said core;

wherein the magnetic field of the magnet is controlled by passing a current through the coil while the superconductor is cooled to below a critical temperature to establish a magnetic field in said superconductor and passing a current produced by said external power source of opposite polarity through the coil to reduce the magnetic field.

2. A variable magnetic field strength composite magnet according to claim 1, wherein said coil is normally conductive.

3. A variable magnetic field strength composite magnet according to claim 1, wherein said coil is superconductive.

4. A variable magnetic field strength composite magnet according to claim 1, wherein R is one or more elements selected from the group consisting of Y, Sm, Eu, Gd, Dy, Ho and Er.

5. A variable magnetic field strength composite magnet according to claim 1, wherein the superconductor is cooled to a temperature of liquid nitrogen.

* * * * *